US005337931A

United States Patent [19]

Kitterman

[11] Patent Number: 5,337,931

[45] Date of Patent: Aug. 16, 1994

[54] DISPENSER VALVE

[76] Inventor: Donald M. Kitterman, 3805 N. Park Dr., Kansas City, Mo. 64116

[21] Appl. No.: 57,351

[22] Filed: May 3, 1993

[51] Int. Cl.[5] ..... B67D 3/00

[52] U.S. Cl. ..... 222/525; 222/537; 222/563

[58] Field of Search ..... 222/525, 537, 563, 558

[56] References Cited

U.S. PATENT DOCUMENTS

| | | | |
|---|---|---|---|
| 3,107,829 | 10/1963 | Makowski | 222/525 |
| 3,157,323 | 11/1964 | Kitterman . | |
| 3,276,640 | 10/1966 | Kessler | 222/525 |
| 3,372,833 | 3/1968 | Baranne | 222/525 |
| 3,422,998 | 1/1969 | Murray | 222/563 |
| 3,439,843 | 4/1969 | Corsette | 222/525 |
| 3,738,545 | 6/1973 | Roy | 222/525 |
| 4,020,981 | 5/1977 | Nixdorff | 222/525 |
| 4,826,055 | 5/1989 | Stull | 222/525 |
| 5,052,595 | 10/1991 | Mon | 222/525 |
| 5,145,094 | 9/1992 | Perlmutter | 222/525 |

*Primary Examiner*—Andres Kashnikow
*Assistant Examiner*—Christopher G. Trainor
*Attorney, Agent, or Firm*—Litman, McMahon & Brown

[57] ABSTRACT

A dispenser valve for use in combination with a plastic dispensing bottle or container wherein the container has an elongate tubular shaped neck with an interior retention bead projecting radially inward from the surface. The mouth is relatively large to allow quick filling of the container. The valve is a push pull type valve including a central tubular member with a head attached to a dispensing end thereof and a vaned tail section attached to an opposite end. The tubular section has an inlet in the middle thereof communicating with a central passageway and the dispensing aperture. The vane section is sized somewhat larger than the width of the retaining bead or neck so as to inhibit removal of the valve from the neck. The valve preferably includes a pair of annular fins surrounding the tubular member with one of the fins extending between the tubular member and the neck so as to both support and seal therebetween. Alternative embodiments of the present invention include various locking mechanisms to prevent the valve from inadvertently being placed in an open position during transit. The valve preferably also includes an integrally molded closure for plugging the dispensing aperture thereof.

5 Claims, 3 Drawing Sheets

Fig.1.
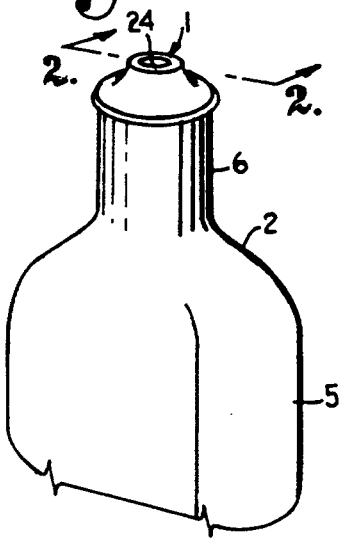
Fig.2.
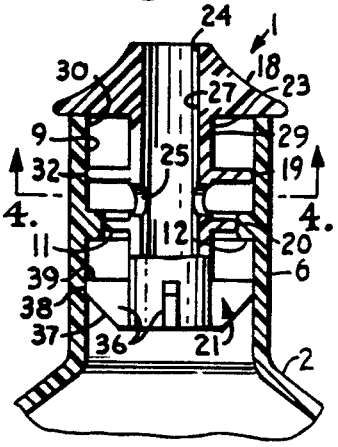
Fig.3.
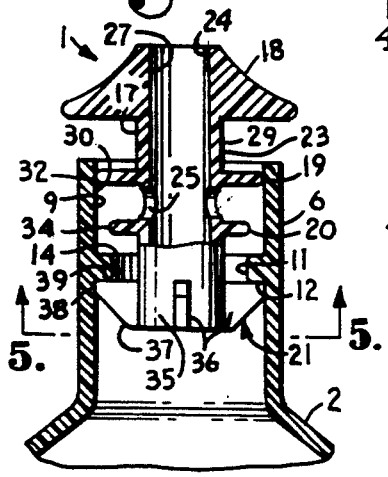
Fig.4.
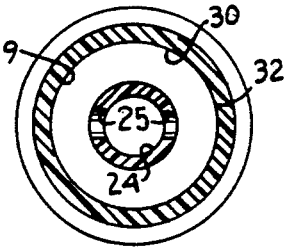
Fig.5.
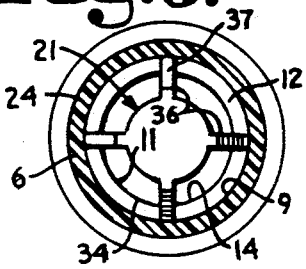
Fig.7.
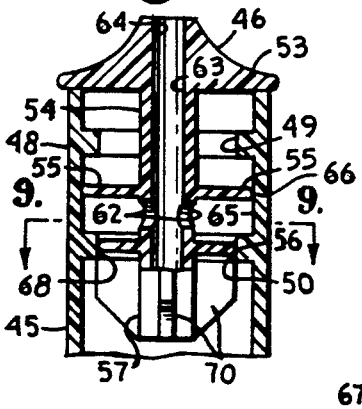
Fig.8.
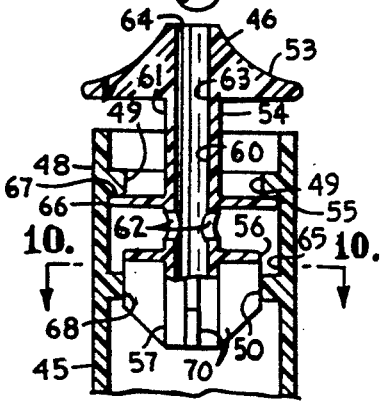
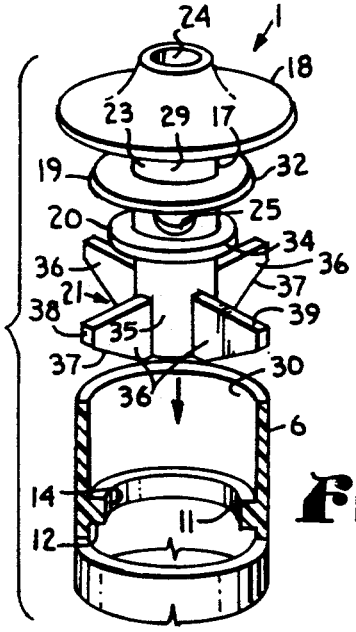
Fig.6.

Fig.9.
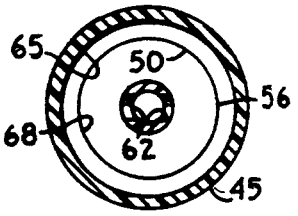
Fig.10.
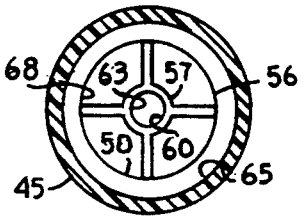
Fig.12.
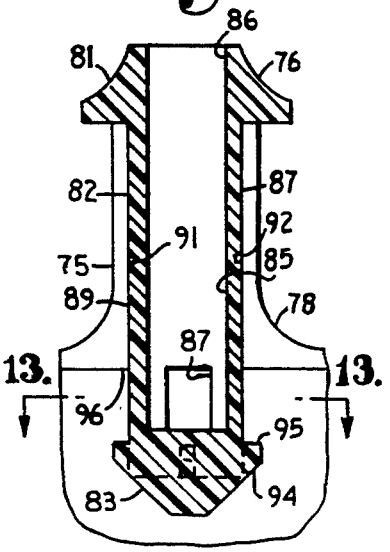
Fig.11.
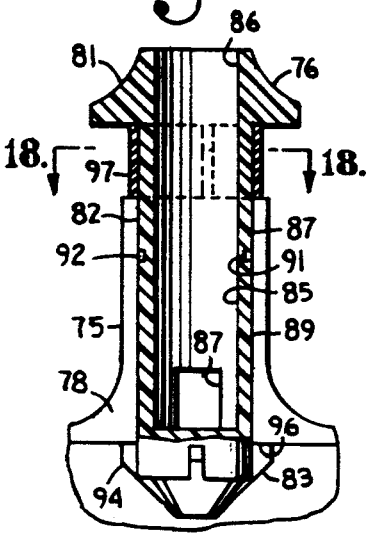
Fig.13.
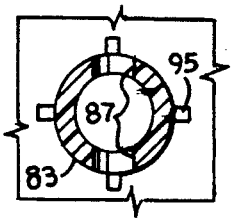
Fig.14.
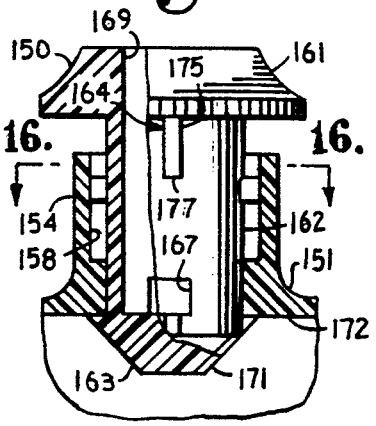
Fig.16.
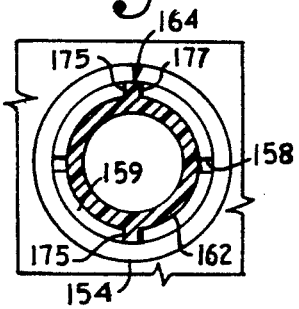
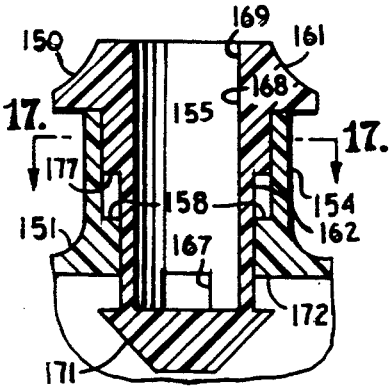
Fig.15.
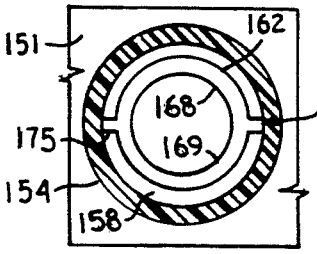
Fig.17.

Fig.18.
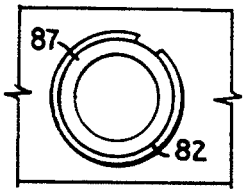
Fig.19.
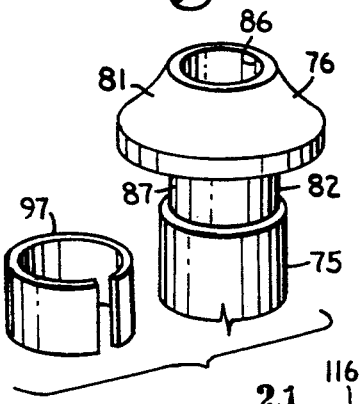
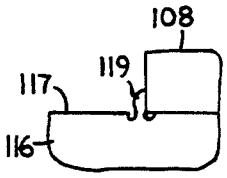
Fig.23.
Fig.20.
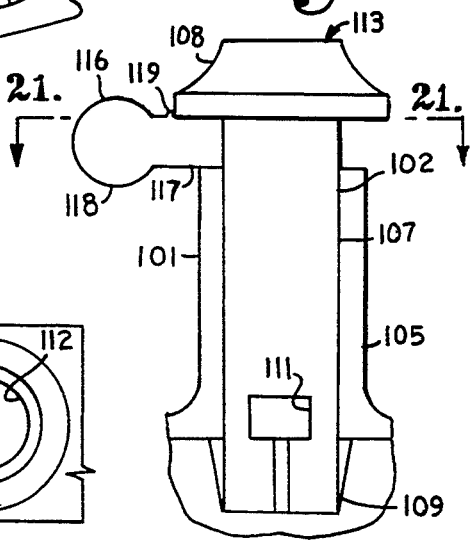
Fig.22.
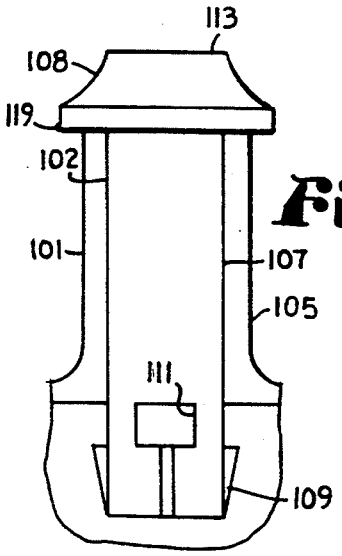
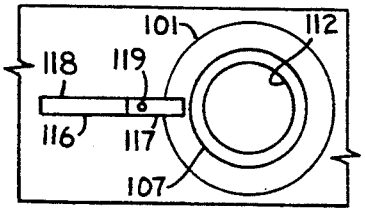
Fig.21.
Fig.24.
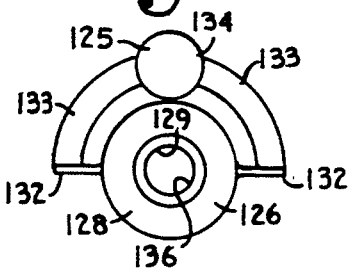
Fig.25.
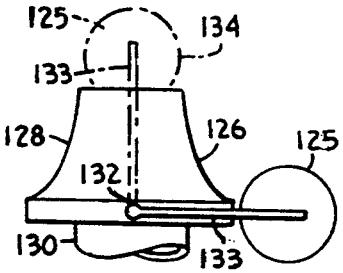
Fig.26.
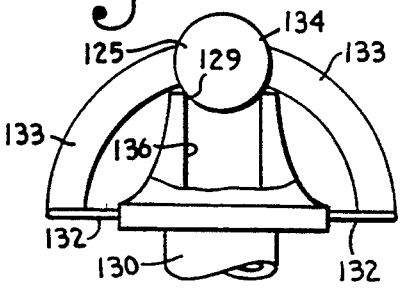

DISPENSER VALVE

BACKGROUND OF THE INVENTION

The present invention relates to a dispenser valve for dispensing liquids, flowable granular solids or the like from a container. In particular, the dispenser valve is of a push pull type especially for use in a neck of a bottle having a relatively large internal diameter to allow easy filling of the bottle.

Numerous types of materials are sold in liquid or powder dispensing bottles or containers, especially many cosmetic, food and cleaning compositions. These products vary greatly and include various types of liquids and other flowable materials such as hand creams, powders, catsup, chocolate syrup and liquid dish washing soap. Push pull type dispensing valves on these containers have made these products very easy to use and the containers of this type have been well accepted by the buying public. Nevertheless, the plastics industry that manufactures the containers and the valves must continuously try to reduce the cost associated with such containers.

In particular, the molding cost associated with the various components of the conventional valves and bottles are quite expensive. In order to manufacture a container that has a rather wide mouth to allow quick and therefore comparatively less expensive filling, the dispensing valve has usually been required to be of a two part construction. This is especially true as it is normally desirable that the dispensing aperture have a significantly less cross sectional area than the mouth of the container. This is because it is usually desirable for flow out of the bottle to be slower than the filling rate of the bottle. Furthermore, it is desirable to have the ability to vary the cross sectional area of the outlet as different products have different preferred flow rates.

As noted above many prior art dispensing valves that were utilized with relatively wide mouth containers normally required a two part construction. Such a construction substantially increased the cost of the valve as a complete mold had to be made for each of the parts at a substantial cost. Consequently it is desirable to provide a single piece dispensing valve that can be molded in a single operation for use in conjunction with a wide mouth container, but have a dispensing channel that is substantially smaller than the mouth.

Furthermore, it is desirable that the dispensing valve be constructed of as little plastic as possible, as the materials cost for the valves increases proportionally with the amount of plastic used.

Also it is desirable that a construction be provided that allows simple variation of the outlet cross section of the valve in accordance with valves made for different products.

It is also noted that it is desirable to maintain the amount of plastic in the valve at a minimum in order to quickly complete the cooling or curing cycle of the plastic so that the valve can then be released from the mold and the mold reused on a quicker basis for producing additional valves.

Finally, it is desirable that valves be of a single piece construction and easily inserted into the mouth of a container to allow for mechanical placement of the valve and for substantial reduction in the labor and machinery required to assemble multi-piece valves.

SUMMARY OF THE INVENTION

A dispensing valve is provided for a container of fluids or other flowable materials having a relatively wide filling mouth to allow the bottle to be quickly and easily filled with product. Preferably the container is not of a type requiring a threaded cap. The container consequently has a neck with a relatively smooth tubular interior and exterior surface that is of a generally constant cross sectional area, especially a circular cross sectional area, except that at least one bead or ring extends radially inward from the surface to provide a retention and sealing shoulder for the dispenser valve. In the process of blow molding the container, the mold can be designed to release the container even with the ring; however, it must not extend too far into the neck so as to obstruct filling of the container.

The valve is of a push pull type. The valve includes a dispensing aperture connected to an elongate tube. The valve tube is sized to provide for a desired flow of the material from the container.

The outside wall of the valve tube is of a substantially smaller diameter than the interior diameter of the container mouth. Extending outwardly from the tube are a pair of fins which are annularly positioned about the valve tube and engage the wall of the container mouth. The fins provide both the function of supporting and stabilizing the valve and as a seal between the tube of the valve and the mouth of the container.

The tube of the valve can be selectively sized to provide adequate flow for the particular material being dispensed from the container. Consequently the tube is enlarged or reduced in size in reverse proportion to the enlargement or reduction in size of the fins in order to fit in a particularly sized container mouth. The tube has a lower inlet aperture which is placed in flow communication with the contents of the container when the valve is open.

The lower fin of the valve preferably is located between the contents of the container and the tube inlet aperture. When the valve is in a closed position, the lower fin seals against the retaining ring of the mouth of the container.

Depending from the lower end of the tube opposite the dispensing aperture is a series of radially outwardly extending and circumferentially spaced fins or vanes. Preferably, the vanes are shaped to have a diameter at least slightly larger than the internal diameter of the container mouth retention ring. The vanes also are tapered to be narrower at the bottom and wider at the top so that when the valve is placed in the mouth of the container the taper allows the vanes to slide over the retaining ring of the mouth of the container. Once the valve is positioned within the mouth of the container, and the valve is pulled upwardly, the top of the vanes engage the retention ring and prevent easy removal of the valve. In this manner the valve is moveable between an open position wherein fluid from the container is allowed to flow past the lower fin, through the tubular inlet aperture, through the valve tube and out a dispensing aperture and a closed position wherein there is no flow. When in the closed position, the lower fin blocks flow of fluid through the valve.

An alternative valve of the present invention is especially useful in conjunction with powders and the like. This particular embodiment also is positioned within a relatively wide mouth container having an internal retention ring as described above. The modified valve further includes a central tube having a depending set of vanes as described above. In the present embodiment, the valve is opened by pushing down so as to expose an aperture communicating the valve tube with the material within the container. Because a valve of this type could be otherwise possibly opened during shipment due to pressure on the top of the valve by boxes positioned on top of the product or the like, a locking mechanism is provided which prevents the valve from being depressed until the locking mechanism is placed in an unlocked position. In particular, the locking mechanism may be a twist type of mechanism that includes a slot and a pin. The slot is effectively formed on the interior of the mouth of the closure and the pin projects from the tube of the valve. When aligned the valve is easily depressed and when not aligned the valve is locked in an upright and closed position.

The present invention also discloses other mechanisms for locking the valve in an upright position including locking rings and twist tabs. Furthermore, the present invention discloses a swingable seal or plug for providing additional protection against discharge of contents through the dispensing aperture of the valve.

OBJECTS AND ADVANTAGES OF THE INVENTION

Therefore the objects of the present invention are: to provide a dispensing valve for use in conjunction with a container having a relative wide mouth, such that the container can be rapidly filled; to provide such a dispensing valve that allows selective sizing of the dispensing aperture so as to provide for flow of different liquids and other flowable materials; to provide such a dispensing valve that minimizes cost of production of the valve by manufacturing of the valve as a single molded piece; to provide such a dispensing valve which also minimizes cost by reducing the amount of plastic required in the valve by utilization of support and sealing fins; to provide such a dispensing valve which can be utilized without requiring a threaded cap; to provide such a dispensing valve constructed of plastic which cools or cures relatively quickly within a mold so as to decrease molding time per unit; to provide such a dispensing valve which is easily inserted within a container and is held therein by use of retention vanes; to provide such a dispensing valve which is easily movable from an open configuration wherein material can flow from the container through the valve to a closed configuration wherein material does not flow through the valve; to provide such a valve of a push down to open type that utilizes a locking mechanism to maintain the valve in a closed position during transit; to provide such a dispensing valve that includes a integrally molded closure for the dispensing aperture of the valve; to provide such a dispensing valve that reduces labor, machine and molding time relative to manufacturing and assembly of the dispensing valve and container; and to provide such a dispensing valve that when used in combination with the container is relatively easy to use, inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 has a fragmentary perspective view of a container incorporating a dispenser valve in accordance with the present invention.

FIG. 2 is a fragmentary, enlarged and cross sectional view of the container and valve with the valve in a closed position, taken along line 2—2 of FIG. 1.

FIG. 3 is a fragmentary, enlarged and cross sectional view of the valve and container, showing the same cross section as FIG. 2 except with the valve in an open configuration thereof.

FIG. 4 is an enlarged and cross sectional view of the container and valve, taken along line 4—4 of FIG. 2.

FIG. 5 is an enlarged and cross sectional view of the container and valve, taken along line 5—5 of FIG. 3.

FIG. 6 is a fragmentary, enlarged and perspective view of the container and valve with portions of the container broken away to show interior detail thereof.

FIG. 7 is a cross sectional view of a first modified container and valve with the valve shown in a closed position thereof.

FIG. 8 is a fragmentary and cross sectional view of the first modified valve and container showing the valve in an open position thereof.

FIG. 9 is a cross sectional view of the first modified container and valve, taken along line 9—9 of FIG. 7.

FIG. 10 is a cross sectional view of the first modified container and valve, taken along line 10—10 of FIG. 8.

FIG. 11 is a cross sectional view from the side showing a second modified container and valve with the valve shown in a closed position thereof.

FIG. 12 is a side elevational view of the second modified container and valve with the valve in an open position thereof.

FIG. 13 is a fragmentary and cross sectional view of the second modified container and valve, taken along line 13—13 of FIG. 12.

FIG. 14 is a side of a third modified container and valve with portions broken away to show detail thereof and with the valve in a closed position thereof.

FIG. 15 is a side elevational view of the third modified container and valve with the valve in an open position thereof.

FIG. 16 is a cross sectional view of the third modified container and valve, taken along line 16—16 of FIG. 14.

FIG. 17 is a cross sectional view of the third modified container and valve, taken along line 17—17 of FIG. 15.

FIG. 18 is a fragmentary and cross sectional view of the second modified valve and container shown in FIG. 11 incorporating a locking ring in a locking configuration thereof, taken along line 18—18 of FIG. 11.

FIG. 19 is a fragmentary and perspective view of the second modified container and valve with the ring shown in FIG. 18, showing the ring removed from locking configuration thereof.

FIG. 20 is side elevational view of a third modified container and valve, including a locking key.

FIG. 21 is a fragmentary and cross sectional view of the third modified container, valve and key, taken along line 21—21 of FIG. 20.

FIG. 22 is a fragmentary and cross sectional view of the third modified container and valve with the key removed and the valve in an open position thereof.

FIG. 23 is an enlarged and fragmentary cross sectional view of the key and valve shown in FIG. 20 and particularly showing the frangible connection therebetween.

FIG. 24 is a top plan view of a fourth modified dispenser valve incorporating an integral closure for the dispensing aperture thereof.

FIG. 25 is a fragmentary and side elevational view of the fourth modified dispenser valve, showing the closure in an opened position in solid lines and in a closed position in phantom lines.

FIG. 26 is a fragmentary side elevational view of the fourth modified dispenser valve and closure, showing the closure in the closed configuration thereof and with portions of the valve broken away to show detail thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a dispensing valve in combination with a materials container 2 in accordance with the present invention.

The container 2 is a container which can be utilized in conjunction with virtually any type of flowable material which does not significantly deteriorate the container. Examples of materials that can be dispensed from the container are liquid soaps, cosmetics including hand creams, powders, food products and the like. The container 2 includes a fluid or other material containing enclosure 5 for holding the material therein and an upper neck 6. The container neck 6 is elongate and except as noted below relatively uniform in thickness and smooth on the interior thereof. The neck 6 surrounds a mouth 9 of the container 2. The neck 6 effectively forms an elongate cylinder or annular tube having a relatively wide internal cross sectional diameter to allow fairly quick filling of the container 2 with the material to be distributed therefrom.

In the embodiment shown in FIGS. 1 through 6 the interior of the tubular neck 6 is generally circular and uniform in a cross sectional area except for a retaining ring 11. It is foreseen that other shapes other than circular are functional under the present invention, such as ovate or rectangular. The retaining bead ring 11 is integrally molded with the container 2 and projects radially inward from the interior of the neck 6. The retaining ring 11 is designed for providing a mechanism to hold the dispensing valve 1 within the container 2.

Preferably, the ring 11 circumferentially and uniformily extends entirely about the neck 6. A shoulder 12 is formed on the lower side of the retaining ring 11 against which the valve 1 abuts when in an open position thereof. The retaining ring 11 also has a radially inward sealing surface 14. The retaining ring 11 projects radially inward and should project only as far as necessary into the interior of the neck 6 to provide enough surface for the shoulder 12 and not so far as to substantially inhibit flow of material into the container 2 during filling. In the illustrated embodiment of FIGS. 1 through 6 the retaining ring 11 projects inwardly approximately one twelfth of the interior diameter of the neck 6 on each side thereof.

It is noted that the material container 2 of the present embodiment does not include a threaded or screw on type cap as is conventionally used for most wide mouth or large opening containers of this type.

The dispensing valve 1 includes a tubular body 17, a head 18, a pair of annular fins 19 and 20 and a vaned tail section 21.

The tubular body 17 includes an elongate circular tube 23 having an outlet or dispensing port 24 at the top thereof, an inner flow passageway, channel or chamber 27 and a side or inlet port 25 medially positioned along the side thereof. While the illustrated tube 23 is round it may be in other shapes such as ovate or square in accordance with the present invention. The inlet port 25, the inner chamber 27 of the tube 23 and the dispensing port 24 are in flow communication with each other. The lower end of the tube 23 is plugged by the tail section 21.

The inner chamber 27 of the tube 23 has a cross sectional diameter that is approximately the same as the dispensing port 24 which in combination with the sizing of the inlet port 25 determines how much flow of material can pass therethrough under a specific dispensing pressure. In effect these parameters determine the flow rate of fluid from the dispensing port 24 and, thus, the interior diameter of the tube 23 can be modified to be larger or smaller depending on the particular type of materials to be dispensed therefrom.

The tube 23 has an outer wall surface 29 having a diameter that is somewhat larger than the diameter of the inner wall surface of the chamber 27, but which is substantially smaller than the diameter of the interior of the container neck 6.

The valve head 18 projects radially outward from the tubular body 17 near the upper end thereof and in surrounding relationship to the dispensing port 24. The head 18 extends at least partially beyond the width of the container neck 6 such that it can be easily grasped by a user and to allow the user to pull the valve 1 upwardly to an open position as seen in FIG. 3. The head 18 serves to allow the user to move the valve 1 to a dispensing configuration with the head 18 raised above the container neck 6 and to prevent the valve 1 from being pushed too far into the container neck 6 when the valve 1 is urged to a closed position, such as is seen in FIG. 2.

The annular fin 19 is integral with the tubular body 17 and extends radially outwardly from the tube outer wall surface 29. In the present embodiment the annular fin 19 extends entirely between the tube outer wall surface 29 and the interior of a section of an inner wall surface 30 of the neck 6. The annular fin 19 is relatively thin in thickness in comparison with radial width and the fin 19 effectively seals between an outer sealing surface 32 thereof and the neck inner wall surface 30. In this manner the annular fin 19 provides an effective seal between the neck 6 and the tubular body 17 of the valve 1 without the use of a substantial amount of plastic to fill the entire volume and with the ability to manufacture the interior of the tube 23 with different diameters such that the valve 1 is supported and positioned relative to the remaining space between the tubular body 17 and neck 6 by the annular fin 19.

The annular fin 20 is positioned below the fin 19 and below the inlet port 25 in the current embodiment. The fin 20 is of somewhat smaller diameter than the fin 19 having a radially outward sealing surface 34. The sealing surface 34 is designed to seal against the retaining ring sealing surface 14 when the valve 1 is in the closed configuration thereof, as is shown in FIG. 2. The annular fin 20 is positioned such that when the valve 1 is moved to the open configuration thereof, as is shown in FIG. 3, the fin 20 moves out of engagement with the neck retaining ring 11. In this manner fluid or other flowable material in the container 2 is free to pass between the retaining ring 11 and the tube outer wall surface 29, around the annular fin 20 and through the inlet port 25 which is positioned between the fins 20 and 19. Thus, when the valve 1 is in the open configuration thereof fluid or the like is free to be dispensed from the dispensing port 24.

The tail section 21 extends beneath the retaining ring 11 when the valve 1 is positioned within the container 2. The tail section includes a cylindrical center portion 35 and four somewhat triangularly shaped and circumferentially spaced upright fins or vanes 36 extending radially outward from the cylindrical center portion 35. The vanes 36 have a lower tapered surface 37 which tapers upwardly and outwardly and an outer truncated surface 38 which engages against the interior of the neck 6. Each of the vanes 36 has an upper surface 39.

The lower tapered surface 37 of each of the vanes 36 is designed such that when the valve 1 is originally placed within the container neck 6 the slant or angle of the surfaces 37 allow the vanes to be urged past the retaining ring 11 because the plastic of construction is one of many non-brittle plastics that are sufficiently elastic or pliable to allow some deformation without breaking and the vanes 36 return to the original shape thereof after insertion.

The valve 1 is also placed within the container 2 under compression which allows a substantial amount of pressure to be applied to urge the vanes 36 past the retaining ring 11. Once the valve 1 is positioned such that the vanes 36 are past the retaining ring 11, an attempt to raise the valve 1 to the open configuration thereof, as is seen in FIG. 3, causes the upper surface 39 of each of the vanes 36 to engage the lower shoulder 12 of the retaining ring 11 and thereby help inhibit removal of the valve 1 completely from the container 2. This helps to positively position the valve 1 and provide stability to the valve 1 when placed in the open configuration thereof.

Because the vanes 36 are spaced from one another, material is allowed to flow past the vanes 36 and through the opening produced between the retaining ring 11 and the tube outer surface wall 29, when the valve 1 is in the open configuration thereof.

In use, the upper and lower annular fins 19 and 20 both provide sealing against unwanted material flow and stability to the valve 1 while both in the closed and open configuration thereof, although in the different configurations the sealing relationship changes.

Shown in FIGS. 7 through 10 is a first modified container 45 and valve 46 in accordance with the present invention. The container 45 is quite similar to the container 2 having an upstanding neck 48 with the exception that the neck 48 includes two inwardly projecting beads or rings 49 and 50. In this embodiment upper ring 49 is a retention and sealing ring while the lower ring 50 is a sealing ring. The valve 46 includes a head 53, a tubular portion 54, an upper annular fin 55, a lower annular fin 56 and a tail section 57.

The valve 46 functions in much the same way as valve 1 of the previous embodiment and, in particular, has an open configuration, as is shown in FIG. 8, and a closed configuration, as is shown in FIG. 7. The head 53 and tubular portion 54 of the present embodiment are quite similar to the previous embodiment except that the internal diameter of the tubular portion 54 is substantially smaller than the internal dimension of the tube 17. The tubular portion 54 has inner wall surface 60, an outer wall surface 61, an inlet port 62 communicating between the wall surface 60 and 61, an interior passageway 63 communicating with the inlet port 62 and an outlet or dispensing port 64 flow communicating with the interior passageway 63. The inlet port 62 is positioned between the upper fin 55 and lower fin 56.

The upper fin 55 in the present embodiment extends between the tubular portion outer wall surface 61 and an interior surface 65 of the neck 48. An outer engaging surface 66 of the upper fin 55 slides along the inner surface 65 of the neck 48 in sealing engagement therewith. The outer upper side 67 of the upper fin 55 engages the upper retaining ring 49 so as to restrict or inhibit removal of the valve 46 from the container neck 48. The valve 46 and/or the container 45 are constructed of materials that are sufficiently pliable or elastic to allow the upper fin 66 to be urged past the retaining ring 49 upon insertion of the valve 46 within the container 45, but sufficiently stiff to provide sealing and resist removal of the valve 46 from the container 45 after returning to the original configuration thereof. Since the valve 46 is placed into the container 45 with compression, it is easier to exert more pressure to seat the fin 66 properly than it is to remove the valve 46 by a person simply pulling upward on the valve head 53.

The lower fin 56 seals against the radially interior surface 68 of the lower retaining ring 50 when the valve is in the closed position thereof, as is shown in FIG. 7. The lower fin 56 is spaced from the retaining ring 50 when the valve 46 is in the open position, as shown in FIG. 8, so as to allow material to flow from the container 45 to around the outside of the lower fin 56, through the inlet port 62, through the interior passageway 63 and out the outlet port 64.

The tail section 57 includes four upright fins or vanes 70 that are cirumferentially spaced therebetween and extend radially outward from the center of the valve 46. The vanes 70 in the present embodiment depend from the lower annular fin 56 and abut against the retaining ring 50 when the valve 46 is in the open position thereof such as is shown in FIG. 8. In this manner the vanes 70 help stabilize the valve 46, but allow flow of materials through the valve 46.

Shown in FIGS. 11 through 13, 18 and 19, is a second modified embodiment of the present invention generally comprising a container 75 and a valve 76. The container 75 is essentially the same as the container described in the first embodiment except that the interior wall of the neck 78 of the container is free from any beads or retaining rings such as are found in the first two embodiments. That is, the interior of the neck 78 is generally smooth and of substantially the same interior cross-section along the entire length thereof.

The valve 76 includes a head 81, a tubular body 82 and a tail section 83. The head 81 is similar to the head of the previous two embodiments and will not be described further herein. The tubular body 82 has an interior passageway 85 connecting with a dispensing aperture 86 and an inlet aperture 87 which passes radially through the side thereof. The tubular body 82 has an outer surface 89 which is approximately the same diameter as the interior surface of the neck 78 so as to abut therewith in sliding engagement. An O-ring type seal 91 is positioned within a groove 92 in the tubular body 82 so as to aid in sealing between the neck 78 and tubular body 82.

The tubular body 82 is longer than the neck 78 such that when the valve 76 is in a closed position thereof, as is shown in FIG. 12, the tail section 83 is positioned below the container neck 78 and the inlet port 87 flow communicates with the interior of the container 75.

The tail section 83 includes a pair of criss-crossed, generally triangularly-shaped vanes 94 which form a generally truncated pyramid-looking structure. The vanes 94 each have an upper surface 95 which engages or butts against a shoulder 96 at the lower end of the neck 78 so as to inhibit total withdrawal from the valve 76 from the container 75, as is seen in FIG. 11. When the valve 76 is in the position shown in FIG. 11, the valve 76 is in a closed configuration thereof and the inlet port 87 is not in flow communication with the contents of the container 75.

In order to prevent the valve 76 from becoming inadvertently opened during transit, a locking ring 97 is positioned about the tubular body 82 between the head 81 and the container neck 78 with the valve 76 in a closed configuration thereof, as is seen in FIG. 18. The locking ring 19 is an incomplete and fairly flexible ring or semi ring which allows easy removal thereof from the tubular body 82 so as to allow a consumer to use the container 75. It is foreseen that the locking ring 19 could have a pulltab or some other structure to facilitate removal.

Shown in FIGS. 20 through 23 is third modified embodiment of the present invention comprising a container 101 and valve 102. The container 101 and valve 102 are quite similar to the container 75 and valve 76 and will, therefore, only be described in general terms. In particular, the container 101 has an elongate neck 105 within which is positioned the valve 102. The valve 102 has an elongate tubular member 107 that extends the length of the neck 105 and has a head 108 attached to one end thereof and a tail section 109 to the opposite end thereof. The tail section 109 maintains the valve 102 in the neck 105 during use. The tubular member 107 includes a lower aperture 111 connected to a central passageway 112 which then flow communicates with a discharge port 113.

In order to maintain the valve 102 in a closed position thereof, as is shown in FIG. 20, a locking key 116 is originally secured to the head 108. The key 116 has a rectangularly-shaped locking section which snugly fits between the lower end of the head 108 and the upper end of the neck 105 when the valve 102 is in the closed position thereof. The locking key 116 also includes a twisting section 118 adapted for grasping by a user. The blocking section 117 is spot-welded at 119 to the head 108 in a manner that allows the locking key 116 to be twisted and broken free from the head 108 by user just prior to initial use. This insures that the contents of the container 101 have not been tampered with and also prevents the valve 102 from inadvertently being opened during transit.

Shown in FIGS. 24 through 26 is a fourth modified embodiment of the present invention illustrating a closure 125 that may be incorporated with any of the valves of the previous embodiments and, in particular, with valve 126. The valve 126 will not be described further except to indicate that it has a head 128 with a dispensing aperture 129 located at the end of a tubular member 130.

The closure 125 is integrally molded with the valve 126. In particular, the closure 125 includes a pair of diagonally extending posts 132 that are integrally molded with and extend radially outward from the head 128. Connected to the posts 132 are a pair of highly flexible arms 133. Joining the two arms 133 together opposite the post 132 is a ball shaped plug 134. The arms 133 have sufficient flexibility that the plug 134 can be selectively rotated from the opened position which is seen in solid lines in FIG. 25 to the closed position which is seen in phantom lines in that same Figure. The advantage of the disclosed closure 125 is that it can be molded integrally with the valve 102 and provide additional ability to close the discharge aperture 129. This is especially useful where they may be some undispensed materials trapped in a passageway 136 just adjacent the dispensing aperture 129 and it is desirable that none of the contents escape.

Shown in FIGS. 14 through 17 is a fifth modified embodiment of the present invention wherein the reference numeral 150 generally represents a valve used in combination with a container 151. The valve 150 is in many ways similar to the valve shown in FIG. 11 and consequently will not be discussed in extensive detail with respect to common features.

The container 151 of the present embodiment has an elongate neck 154 surrounding a mouth 155. The neck 154 has a pair of vertical slots 158 extending radially outwardly into the neck 154 from the interior surface thereof. Connected with the upper end of the slots 158 is a shelf 159 that extends around the circumference of the neck mouth 155 near the discharge thereof.

The valve 150 includes a head 161, a tubular portion 162, a tail section 163 and a locking mechanism 164. The tubular portion 162 is longer than the container neck 154 and has the head 161 mounted thereon at an opposite end from the tail section 163. The tubular portion 162 also has an inlet port 167 and internal passageway 168 and a discharge aperture 169. The tail section 163 includes a set of vanes 171 which engage a lower shoulder 172 of the container neck 154 when the valve 150 is placed within the neck 154 and the valve 150 is in a closed position, as seen in FIG. 14. The valve 150 and, especially the tubular portion 162, function in the same way as described for the valve and tubular portion of the embodiment shown in FIG. 11.

The valve locking mechanism comprises a pair of stops 175 positioned so as to extend radially outward from the outer surface of the tubular portion 162. The stops 175 extend from the head 161 downward and are configured in shape to slide within the slots 158 when the stops 175 are aligned with the slots 158, as is shown with the valve 150 in an open position in FIGS. 15 and 17. When the stops 175 are rotated so that the valve 150 is in the closed position as seen in FIGS. 14 and 16, the bottom 177 of each stop abuts against the shelf 159 and prevents the valve 150 from being lowered to the open position thereof.

The dispenser valves and containers of the present invention can be constructed of a wide variety of plastics that are resilient, such as polyethylene or the like.

It is to be understood that while certain forms of the present invention have been illustrated and described herein, it is not to be limited to the specific forms or arrangement of parts described and shown.

What is claimed and desired to be secured by Letters Patent is as follows:

1. A dispensing valve in combination with a wide mouth container comprising:

(a) a container having an elongate neck surrounding a mouth; said neck having an interior surface that has a portion that is generally uniform in radial cross-section except for at least one radially inward projecting ring;

(b) said valve comprising:

1) a tubular body having an inner wall surrounding an elongate passageway and an outer wall having a cross-section substantially smaller than the cross-section of the interior of said neck; said inner and outer walls connected by an inlet port that is flow connected with said passageway; said elongate passageway terminating in an upper dispensing port;

2) a first annular fin circumferentially positioned about and extending radially outward from said tubular body outer wall; said first annular fin having a radially outer surface sealably engaging said neck interior surface;

3) a second annular fin circumferentially positioned about and extending radially outward from said tubular body and positioned such that said inlet port is located between said first and second annular fins; said second annular fin having a sealing surface that is positioned to sealingly engage said neck ring when said valve is in a closed configuration thereof; said second annular fin being of substantially less diameter than said neck interior surface such that when said valve is moved to an open configuration thereof, material may flow from said container around said second annular fin, through said inlet port, through said passageway and out said dispensing port; and 4) said inlet port passing radially through said tube from the inner wall to the outer wall thereof; said inlet port being located between said first and second fins such that when said valve is in the open configuration thereof, material may flow from said container between said first and second fins and then directly through said port to the passageway of said tube.

2. A valve and container according to claim 1 wherein said valve further comprises:

(a) a tail section having a plurality of circumferentially spaced and radially extending vanes; said vanes having a width greater than the interior width of said neck ring such that when said valve is positioned within said container neck with said vanes beneath said ring, said vanes engage said ring when in a fully opened configuration thereof so as to inhibit complete withdrawal of said valve from said container neck.

3. The valve and container according to claim 2 wherein:

(a) said vanes are tapered so as to have a lower taper surface that tapers from the lower inner side thereof to the upper outer side thereof such that as said valve is positioned within said container neck said vanes and said ring cooperate to elastically deform to allow passage of said vanes past said ring and thereafter said vanes elastically return to their original shape so as to inhibit removal of said valve from said container neck.

4. The valve and container according to claim 1 wherein:

(a) said valve includes a head projecting radially outward from said tubular body and surrounding said outlet port; said head extending radially outward beyond the outer edge of said container neck so as to prevent said valve from being inadvertently completely pushed into said container neck.

5. A valve and container according to claim 1 wherein:

a) the thickness of said tubular body between said inner and outer walls thereof is substantially thin as compared to the width of said passageway; and b) said inlet port is formed by a circular opening that is axially alligned with a radius of said passageway.

* * * * *